US010513138B2

(12) United States Patent
Martinovic

(10) Patent No.: US 10,513,138 B2
(45) Date of Patent: Dec. 24, 2019

(54) TRANSFER MEDIUM

(71) Applicant: KASPAR PAPIR PTE LTD, Singapore (SG)

(72) Inventor: Zvonimir Martinovic, Varazdin (HR)

(73) Assignee: KASPAR PAPIR PTE LTD, Singapore (SG)

( * ) Notice: Subject to any disclaimer, the term of this patent is extended or adjusted under 35 U.S.C. 154(b) by 0 days.

(21) Appl. No.: 14/653,002

(22) PCT Filed: Dec. 16, 2013

(86) PCT No.: PCT/EP2013/076767
§ 371 (c)(1),
(2) Date: Jun. 17, 2015

(87) PCT Pub. No.: WO2014/095762
PCT Pub. Date: Jun. 26, 2014

(65) Prior Publication Data

US 2015/0375552 A1 Dec. 31, 2015

(30) Foreign Application Priority Data

Dec. 17, 2012 (EP) ..... 12197563

(51) Int. Cl.
*B41M 5/50* (2006.01)
*D21H 19/12* (2006.01)
*D21H 19/38* (2006.01)
*D21H 19/56* (2006.01)

(52) U.S. Cl.
CPC ..... *B41M 5/508* (2013.01); *B41M 5/50* (2013.01); *D21H 19/12* (2013.01); *D21H 19/385* (2013.01); *D21H 19/56* (2013.01)

(58) Field of Classification Search
CPC ..... B41M 5/508; B41M 5/50; D21H 19/12; D21H 19/385; D21H 19/56
See application file for complete search history.

(56) References Cited

U.S. PATENT DOCUMENTS

| | | | | |
|---|---|---|---|---|
| 5,039,598 | A | 8/1991 | Abramsohn et al. | |
| 5,897,961 | A | 4/1999 | Malhotra et al. | |
| 6,028,028 | A | 2/2000 | Nitta | |
| 6,280,831 | B1 * | 8/2001 | Nakanishi | G03G 7/00 428/211.1 |
| 6,391,154 | B1 * | 5/2002 | Nyg.ang.rd | D21H 11/10 162/135 |
| 6,902,779 | B1 | 6/2005 | de Visser et al. | |
| 7,341,768 | B2 | 3/2008 | de Visser et al. | |
| 7,662,451 | B2 | 2/2010 | de Visser et al. | |
| 2001/0031344 | A1 | 10/2001 | Nordeen et al. | |
| 2002/0098326 | A1 * | 7/2002 | Sato | B41M 5/0256 428/32.12 |
| 2002/0170691 | A1 * | 11/2002 | Nygard | D21H 21/52 162/135 |
| 2004/0109958 | A1 | 6/2004 | Nigam et al. | |
| 2005/0186363 | A1 * | 8/2005 | de Visser | B41M 5/0256 428/32.12 |
| 2008/0008864 | A1 | 1/2008 | Itoh | |
| 2008/0063818 | A1 | 3/2008 | de Visser et al. | |
| 2009/0104383 | A1 | 4/2009 | Terao et al. | |
| 2012/0160119 | A1 | 6/2012 | Martinovic | |

FOREIGN PATENT DOCUMENTS

| | | | |
|---|---|---|---|
| CN | 101448999 | A | 6/2009 |
| CN | 101537743 | A | 9/2009 |
| DE | 27 10 230 | | 9/1978 |
| EP | 0 350 257 | A1 | 1/1990 |
| EP | 0 516 505 | A1 | 12/1992 |
| EP | 1356953 | A1 | 10/2003 |
| EP | 1 878 829 | A1 | 1/2008 |
| EP | 2014688 | B1 | 1/2009 |
| EP | 2 236 307 | A1 | 10/2010 |
| EP | 2 418 090 | A2 | 2/2012 |
| EP | 2 236 307 | A1 | 7/2012 |
| JP | S60-38199 | A | 2/1985 |
| JP | 10-86599 | A | 4/1988 |
| JP | 2002-59693 | A | 2/2002 |
| JP | 2002-521 245 | A | 7/2002 |
| JP | 2003-266919 | A | 9/2003 |
| JP | 2003-328282 | A | 11/2003 |
| JP | 2003-336183 | A | 11/2003 |
| JP | 2004-255 715 | A | 9/2004 |
| JP | 2004-255717 | A | 9/2004 |
| JP | 2005-307 419 | A | 11/2005 |
| JP | 2007-508 969 | A | 4/2007 |
| JP | 2007-178669 | A | 7/2007 |
| JP | 2009-291968 | A | 12/2009 |
| JP | 2010-037697 | A | 2/2010 |
| JP | 2012-521909 | A | 9/2012 |
| WO | 97/18090 | A1 | 5/1997 |
| WO | 00/06392 | A1 | 2/2000 |
| WO | 2004052655 | A1 | 6/2004 |
| WO | 2005 042262 | A1 | 5/2005 |
| WO | 2007/111302 | A1 | 10/2007 |
| WO | 2008006434 | | 1/2008 |
| WO | 2008065395 | A1 | 6/2008 |
| WO | 2010/112507 | A1 | 10/2010 |
| WO | 2012/152281 | A1 | 11/2012 |

OTHER PUBLICATIONS

Machine translation of EP 2418090, Feb. 2012.*
Translation of EP 2418090 A2, Feb. 15, 2012.*
Translation of EP 2418090 A3, Feb. 15, 2012.*
Definition of silicate on p. 1035 and the definition of silica on p. 1034 of Hawley's Condensed Chemical Dictionary, Twelfth Edition, 1993.*
Extended European Search Report dated May 10, 2015 issued for European Application No. 12197563.5, 6 pages.
International Preliminary Report on Patentability dated Jun. 23, 2015 for PCT/EP2013/076767, 8 pages.
International Search Report PCT/EP2013/076767 dated Feb. 12, 2014 (3 pages).

* cited by examiner

*Primary Examiner* — Robert S Walters, Jr.
(74) *Attorney, Agent, or Firm* — Rothwell, Figg, Ernst & Manbeck, P.C.

(57) ABSTRACT

The present invention relates to a method for producing a transfer medium, to the transfer media produced by this method and to transfer printing methods.

23 Claims, No Drawings

TRANSFER MEDIUM

CROSS REFERENCE TO RELATED APPLICATION

This application is a 35 U.S.C. 371 National Phase Entry Application from PCT/EP2013/076767, filed Dec. 16, 2013, which claims the benefit of European Patent Application No. 12197563.5 filed on Dec. 17, 2012, the disclosure of which is incorporated herein in its entirety by reference.

The present invention relates to a method for producing a transfer medium, to the transfer media produced by this method and to transfer printing methods.

Transfer printing denotes the printing of different materials, such as textiles, using e.g. transfer media. Transfer media are coated with pigments which are subsequently transferred onto the material to be printed e.g. by sublimation using a thermal transfer press.

A drawback frequently encountered in transfer media is that the pigments applied, for example by ink-jet printing, smear. This drawback may be reduced when using transfer media which have been coated with hydrophilic polymers. However, even such modification of the transfer medium does not completely overcome smearing of the ink.

EP 2 236 307 discloses transfer media which are coated with aqueous liquids comprising ammonium polyacrylate on the front side of a base paper to be printed.

WO 00/06392 discloses a transfer medium, in particular for ink-jet printing, provided at least on the side to be printed with a release or barrier layer, the release or barrier layer having a porosity of at most 100 ml/min. The release/barrier layer may be a coating of a hydrophilic polymer such as carboxymethyl cellulose, gelatine or alginate. The transfer media described in WO 00/06392 are said to have a reduced smearing tendency even when ink-jet printed and a high transfer efficiency of the ink to the article.

It has surprisingly been found that the use of transfer media exhibiting a base substrate having a porosity of 0-1,000 ml/min, preferably 0-200 ml/min, comprising at least one hydrophilic organic polymer or salt thereof applied to the front side of the base substrate to be printed results in high-resolution patterns on the articles to be printed and a high yield of ink to be transferred to the articles.

It has surprisingly been found that the use of transfer media exhibiting a base substrate having a low porosity and a coating comprising at least one hydrophilic organic polymer applied to the front side of the base substrate to be printed results in high-resolution patterns on the articles to be printed and a high yield of ink to be transferred to the articles. It turned out that the use of low-porous base substrate, e.g. having a porosity of 0-1,000 ml/min, preferably 0-200 ml/min or more preferably 0-100 ml/min, prevents the ink from penetrating into the medium, which may explain the high transfer rate of the ink to the article to be printed.

In an alternative embodiment, the base substrate may have a porosity of >100 to 1,000 ml/min, preferably >100 to 200 ml/min, since it has been found that the coating comprising at least one hydrophilic organic polymer has a relatively low porosity per se, which also prevents the ink from penetrating the medium and which may explain the high transfer rate of the ink to the article to be printed.

On the other hand, the specific coating on the base substrate provides a layer which results in ideal printing performance, such as fast drying of the ink and low smearing tendency. The property profile of the transfer medium of the invention makes possible a print application at home (e.g. by a conventional desktop-printer), without the need for any professional equipment.

Moreover, the transfer medium according to the present invention allows a reduction of costs of materials, since not only the weight per unit area of the substrate but also the coating weight can be significantly reduced compared to conventional transfer media, e.g. as described in WO 00/06392.

Hence, the object of the present invention is to provide a cost-effective and environment-friendly process for producing a transfer medium exhibiting optimal printing performance.

Thus, in a first aspect, the present invention is directed to a process for manufacturing a transfer medium, particularly for ink-jet printing, comprising the steps:

(a) applying a first aqueous liquid to the front side of a base substrate to be printed, wherein
  the base substrate has a porosity of 0-1,000 ml/min, preferably 0-200 ml/min, more preferably 0-100 ml/min, and the first aqueous liquid comprises at least one hydrophilic organic polymer or a salt thereof, and
  subsequent drying; and (b) optionally applying a second aqueous liquid to the reverse side of the base substrate and subsequent drying, the second liquid optionally comprising a hydrophilic polymer or a salt thereof.

In a preferred embodiment, the base substrate is selected from the group consisting of paper, plastic such as polyester, polyamide or polyolefin, or metal, such as aluminum, iron or alloys thereof. In a preferred embodiment, the base substrate is a base paper. In such case, the base paper preferably has a grammage of 20-120 g/m$^2$, particularly of 35-90 g/m$^2$. Preferably, the base substrate is in the form of sheets or films.

The porosity of the base substrate is in the range of 0-1,000 ml/min, preferably 0-800 ml/min, more preferably 0-200 ml/min and even more preferably 0-100 ml/mm, when measured according to ISO standard 5636-3 (Bendtsen porosity). Preferably, the base substrate has a minimum porosity of e.g. 2, 10 or 20 ml/min, such that the water of the first aqueous liquid as well as the water of the aqueous inks to be printed thereon can be at least partially absorbed.

In one embodiment, the porosity of the base substrate is preferably in the range of 0-100 ml/min, more preferably 20-90 ml/min, even more preferably 50-90 ml/min, when measured according to ISO standard 5636-3 (Bendtsen porosity). Preferably, the base substrate has a minimum porosity of e.g. 2, 10 or 20 ml/min, such that the water of the first aqueous liquid as well as the water of the aqueous inks to be printed thereon can be at least partially absorbed.

In an alternative embodiment, the porosity of the base substrate is in the range of >100 ml/min to 1,000 ml/min, preferably >100 to 800 ml/min, preferably >100 to 200 ml/min, more preferably 120-180 ml/min, even more preferably 120-160 ml/min, when measured according to ISO standard 5636-3 (Bendtsen porosity). Preferably, the base substrate has a minimum porosity of e.g. 101, 105 or 110 ml/min.

In a preferred embodiment, the base substrate may have a Cobb value of 0-100, preferably 0-80, more preferably 0-40, even more preferably 1-40. The Cobb value is the mass of water absorbed in a specific time by a one square meter sample of substrate corrugated under conditions specified in standard TAPPI T441.

In a preferred embodiment, the hydrophilic organic polymer is sufficiently soluble in water to form an aqueous liquid. According to the invention, the hydrophilic organic polymer or its salt may be sufficiently water-soluble if at least 10 g, preferably at least 20 g, more preferably at least 50 g per liter water can be completely dissolved in distilled water at 20° C. Preferably, the hydrophilic organic polymer is selected from the group consisting of polyacrylic acid, polyacrylester, polyacrylamide, polyvinyl alcohol, a copolymer comprising at least one of an acrylic acid, acrylic acid ester, acryl amide and vinyl acetate, and salts thereof.

The hydrophilic organic polymer may have a weight average molecular weight of 500 g/mol or more, for example 600 to 50,000 g/mol, preferably 600 to 25,000 g/mol.

Salts of the hydrophilic organic polymers may comprise as counterion, alkali cations, such as potassium or sodium cations, or ammonium cations.

Preferably, polyacrylic acid or a salt thereof (polyacrylate) and even more preferably polyacrylate is used as a hydrophilic organic polymer. Polyacrylate in the sense of the present invention means a salt of polyacrylic acid, the carboxylic acid groups of which are at least partly present in the form of a carboxylate salt. In a preferred embodiment, the polyacrylate is selected from the group consisting of alkali polyacrylate, such as sodium or potassium polyacrylate, or ammonium polyacrylate. In a preferred embodiment, the polyacrylate is sodium polyacrylate, potassium polyacrylate or ammonium polyacrylate, most preferably sodium polyacrylate.

The first aqueous liquid preferably comprises from 1-50 weight-%, preferably 2-20 weight-% and even more preferably 4-12 weight-% of at least one hydrophilic organic polymer based on the total mass of the first aqueous liquid.

In a preferred embodiment, the first aqueous liquid may further comprise at least one filler, preferably an inorganic filler, more preferably an inorganic oxide such as $SiO_2$ or $TiO_2$. The filler is preferably in a nano- or micro-particulate form. In a preferred embodiment, the filler used in the first aqueous liquid is in the form of a colloidal solution, wherein the mean average size of the solid particles may be in the range of 1 nm to 1 μm, preferably 1 nm to 800 nm, more preferably 10 nm to 100 nm.

The filler may be present in the first aqueous liquid in an amount of 0.2-10 weight-%, preferably 1-5 weight-%, based on the total mass of the first aqueous liquid.

In another preferred embodiment, the first aqueous liquid may further comprise at least one water-soluble salt. Preferably, the salt is an alkaline salt. An alkaline salt as used herein is a salt which has a pH value of >7 at 20° C. in a saturated aqueous solution. Preferably, the salt may be selected from a (hydrogen)carbonate, a silicate, an aluminate, a phosphate or mixtures thereof. Preferably, the first aqueous liquid comprises (hydrogen)carbonates and silicates. The salt(s) may be present in the first aqueous liquid in an amount of from 0.2 to 10 weight-%, preferably 1-5 weight-%, based on the total mass of the first aqueous liquid.

In a further embodiment, the first aqueous liquid may comprise at least one polyhydric alcohol, such as glycerol, polyethylene glycol, ethylene glycol or 1,3-butanediol. The polyhydric alcohol may be present in an amount of 0.01-3 weight-%, preferably 0.1-1.5 weight-%, more preferably 0.1-1.2 weight-%, based on the total mass of the first aqueous liquid.

In another preferred embodiment, the first aqueous liquid may further comprise at least one adhesive. The adhesive provides a sticky effect to the front side to be printed and thus assures that the transfer paper does not shift when applied to an article to be printed. The adhesive may be selected from the group consisting of silicone adhesive, adhesives based on natural or synthetic rubber, such as blendex. The adhesive may be present in the first aqueous liquid in an amount of 10-20 weight-% based on the total mass of the first aqueous liquid.

In a preferred embodiment, the first aqueous liquid has a pH value of 2-5, preferably 2.5-4.5, more preferably 2.5-4.

In a preferred embodiment, the first aqueous liquid comprises a polyacrylate, particularly in an amount of 4-6 weight-%, a filler, particularly in an amount of 0.5-2.5 weight-%, and at least one water-soluble alkaline salt, particularly in an amount of 1.5-3.5 weight-%, each based on the total amount of the first aqueous liquid.

In another preferred embodiment, the first aqueous liquid comprises a polyacrylic acid, particularly in an amount of 4-15 weight-%, a filler, particularly in an amount of 0.05-4 weight-%, at least one water-soluble alkaline salt, particularly in an amount of 1.5-7 weight-%, at least one polyhydric alcohol, particularly in an amount of 0.1-1.5 weight-%, and optionally at least one adhesive, particularly in an amount of 10-20 weight-%, each based on the total amount of the first aqueous liquid.

In a preferred embodiment, the second aqueous liquid comprises hydrophilic polymers such as polyacrylate, starch, cellulose or derivatives thereof. Derivatives of starch may be hydrophilized starch. Derivatives of cellulose are preferably selected from hydroxypropylmethylcellulose (HPMC), ethylcellulose (EC), carboxymethyl cellulose (CMC), or microcrystalline cellulose. The hydrophilic polymers may be present in amounts of 1-50 weight-%, preferably 5-30% by weight, in particular in a proportion of 10-20% by weight, based on the total weight of the second aqueous liquid.

In a preferred embodiment, the first and optionally the second aqueous liquid is applied to the base substrate in an amount of 10-40 g/m$^2$, preferably 15-25 g/m$^2$. In a preferred embodiment, the first and optionally the second aqueous liquid is applied to the base substrate such that a dry weight of the coating of about 0.2-25 g/m$^2$, preferably 0.2-5 g/m$^2$, is obtained.

In a preferred embodiment, the dried coating layer deriving from the first aqueous liquid has a porosity of >100 ml/min, preferably of 200 to 600 ml/mm, most preferably of 300 to 600 ml/min, when measured according to ISO standard 5636-3 on a high-porosity base substrate (e.g. high-porosity base paper) having a porosity of 700-800 ml/min. That is, for measuring the porosity of the dried coating layer, the process for manufacturing the transfer medium according to the invention is reproduced, except that a highly porous base substrate having a porosity of 700-800 ml/min (instead of the base substrate of the invention) is used.

It was surprisingly found that the effective amount of the first aqueous liquid to be applied to the low porous base substrate can significantly be reduced as compared to an application on a higher porous base substrate—without sacrificing the transfer printing performance.

Also, the high porosity of the coating layer has an advantageous effect on the performance of the transfer medium. On the one hand, the porous coating layer allows rapid absorption of the aqueous ink applied to the transfer medium, thereby reducing the tendency to smear. On the other hand, the high porosity of the coating allows significant reduction of the overall drying time of the ink after printing.

The overall low porosity of the coated base substrate prevents the ink from penetrating the interior of the substrate so that it can be transferred efficiently onto the article, e.g. during sublimation transfer. This makes the transfer media according to the present invention particularly suitable for printing with customary desktop ink-jet printers (so called high-speed transfer media).

The first aqueous liquid can be applied onto the base substrate by conventional methods, for example using a doctor blade, a rollcoater or by spraying. After the application, the paper is usually dried at room temperature, or at an elevated temperature, for example at 40-100° C., more preferably at 40-80° C., even more preferably at 40-60° C.

Step (b) preferably comprises applying a second aqueous liquid to the reverse side of the paper and subsequent drying. The application of the second liquid and the subsequent drying can be performed as described above for the first aqueous liquid.

In another aspect, the present invention is directed to a transfer medium obtainable by the above-described process.

A further aspect of the present invention is the use of an aqueous liquid, which comprises at least one hydrophilic organic polymer, at least one filler and at least one alkaline salt for the production of a transfer medium, particularly for ink-jet printing. Preferably, the first aqueous liquid as described above may be used as an aqueous liquid for producing the transfer medium.

A further aspect of the present invention is the use of an aqueous liquid, which comprises at least one hydrophilic organic polymer, at least one filler, at least one alkaline salt, at least one polyhydric alcohol and optionally at least one adhesive for the production of a transfer medium, particularly for ink-jet printing. Preferably, the first aqueous liquid as described above may be used as an aqueous liquid for producing the transfer medium.

Another aspect of the invention is the use of a base substrate, particularly a base paper, having a porosity of 0-1,000 ml/min, preferably 0-200 ml/min, more preferably 0-100 ml/min, even more preferably 20-90 ml/min, or preferably >100 to 1,000 ml/min, more preferably 120-180 ml/min, for preparing a transfer medium, in particular a transfer paper, e.g. for ink-jet printing.

Another aspect of the invention is the use of a base substrate, particularly a base paper, having a porosity of 0-100 ml/min, preferably 20-90 ml/min, more preferably 50-90 ml/min for preparing a transfer medium, in particular a transfer paper, e.g. for ink-jet printing.

Another aspect of the invention is a transfer medium, particularly for ink-jet printing, wherein the front side of a base substrate to be printed is coated with a coating comprising at least one hydrophilic organic polymer and wherein the base substrate has a porosity of 0-1,000 ml/min, preferably 0-200 ml/min, more preferably 0-100 ml/min, even more preferably 20-90 ml/min, or preferably >100 to 1,000 ml/min, more preferably 120-180 ml/min. Preferably, the coating has a porosity of >100 ml/min, preferably of 200-600 ml/min, most preferably of 300-600 ml/min, when measured according to ISO standard 5636-3 on a high-porosity base substrate (e.g. high-porosity base paper) having a porosity of 700-800 ml/min. The coating may derive from a first aqueous liquid as described above.

Another aspect of the invention is a transfer medium, particularly for ink-jet printing, wherein the front side of a base substrate to be printed is coated with a coating comprising at least one hydrophilic organic polymer and wherein the base substrate has a porosity of 0-100 ml/min, preferably 20-90 ml/min. Preferably, the coating has a porosity of >100 ml/min, preferably of 200 to 600 ml/min, most preferably of 300 to 600 ml/min, when measured according to ISO standard 5636-3 on a high-porosity base substrate (e.g. high-porosity base paper) having a porosity of 700-800 ml/min. The coating may derive from a first aqueous liquid as described above.

Another aspect of the invention is a process for printing a transfer medium, wherein sublimable pigments are applied to the front side of the transfer medium of the invention, for example by ink-jet printing. The pigments can be applied via conventional printing inks by known methods using conventional devices, for example ink-jet printers, more preferably desktop ink-jet printers.

The printed transfer medium may be dried at room temperature or at an elevated temperature of up to 80° C. However, it was found that the transfer medium according to the invention, when printed, does not require a separate drying step at increased temperatures.

The printed transfer medium can be used in a known manner for printing articles, in particular textiles. Thus, a further aspect of the present invention is a printed transfer medium for printing articles, in particular textiles, wherein sublimable pigments are applied to the coated front side of the transfer medium according to the invention.

The present invention further provides a process of printing articles and in particular textiles, wherein the article to be printed is brought into contact with a printed transfer medium according to the invention at increased temperature, for example at 160-240° C., in such a way that sublimable pigments are transferred from the transfer medium to the article to be printed.

The articles to be printed are conventionally undyed or white. However, predyed articles may optionally also be used, particularly when using textiles to be printed. The textiles which may be involved comprise a proportion of at least 50-60% by weight polyester and/or polyamide fibers or are coated with polyester and/or polyamide.

During the transfer process, pressures of e.g. 1 up to 50 bar may also be applied. In a preferred embodiment, the transfer of the sublimable pigments to the article to be printed is particularly carried out between rolls exerting said pressure, e.g. by means of roller printing, heat transfer roll press and/or heat transfer flat press.

EXAMPLES

Example 1

Preparation of the First Aqueous Liquid 100 g of water, 10 g of aqueous colloidal $SiO_2$ ($SiO_2$ content: 30 wt.-%), 4 g of $Na_2SiO_3$, 1 g of $NaHCO_3$, 40 g of aqueous polyacrylic acid (polyacrylic acid content: 25 wt.-%) and 30 g of water are mixed together at room temperature in the respective order to give a clear first aqueous liquid.

Production of Transfer Paper

The first aqueous liquid obtained above was applied to a base paper having a porosity of 81 ml/min and a grammage of 80 g/m$^2$ (KRPA, Czech Republic). The first aqueous liquid was applied by using a 12 μm rod and then dried at 100° C. The dry weight of the coating layer was determined to be 0.864 g/m$^2$.

In order to determine the porosity of the coating layer, the first aqueous liquid was applied in the same manner as described above on a base paper having a porosity of 710 ml/min (Lenzing, 70 g/m$^2$) and dried under the respective conditions. The porosity according to ISO standard 5636-3 of the coated paper is 420 ml/min and can be regarded as the porosity of the coating layer itself.

Ink-Jet Printing

Multicolor patterns using sublimable dyes (Jtech) were applied to the above-produced transfer medium via an ink-jet printer (EPSON). After 60 seconds, the printed transfer medium was completely dried and was used for a transfer printing process.

The printed transfer medium had very clear outlines and did not show any tendency towards smearing.

Transfer Printing

The printed transfer medium was contacted with a piece of polyester fabric and was treated at about 200° C. for about 45 seconds in a press at 4 bar. Following completion of the transfer print, a textile fabric with a mirror-inverted ink-jet pattern was obtained, the outlines of which were very clear.

As shown above, the method as well as the transfer media of the present invention provide very convenient means for transfer printing.

Example 2

Preparation of the First Aqueous Liquid 440 g of water, 100 g of aqueous colloidal $SiO_2$ ($SiO_2$ content: 30 wt.-%), 33 g of $Na_2SiO_3$, 14 g of $NaHCO_3$ and 310 g of aqueous polyacrylic acid (polyacrylic acid content: 35 wt.-%) are mixed together at room temperature to give a clear first aqueous liquid.

Production of Transfer Paper

The first aqueous liquid obtained above was applied to a base paper having a porosity of 150 ml/min and a grammage of 80 g/m$^2$ (wood-free base paper). The first aqueous liquid was applied by using a 12 μm rod and then dried at 100° C. The dry weight of the coating layer was determined to be 3 g/m$^2$.

The porosity according to ISO standard 5636-3 of the coated paper is 120 ml/min.

The following items are also subject of the present invention:

1. A process for manufacturing a transfer medium, particularly for ink-jet printing, comprising the steps:
   (a) applying a first aqueous liquid to the front side of a base substrate to be printed, wherein
      the base substrate has a porosity of 0-1,000 ml/min, preferably 0-200 ml/min, more preferably 0-100 ml/min, and
      the first aqueous liquid comprises at least one hydrophilic organic polymer or a salt thereof, and
      subsequent drying; and
   (b) optionally applying a second aqueous liquid to the reverse side of the base substrate and subsequent drying, the second liquid optionally comprising a hydrophilic polymer or a salt thereof.

2. The process according to item 1, wherein the base substrate is selected from the group consisting of paper, plastic, or metal.

3. The process according to item 2, wherein the base paper has a grammage of 20-120 g/m$^2$, particularly of 35-90 g/m$^2$.

4. The process according to any of items 1-3, wherein the hydrophilic organic polymer is selected from the group consisting of polyacrylic acid, polyacrylester, polyacrylamide, polyvinyl alcohol, a copolymer comprising at least one of an acrylic acid, acrylic acid ester, acryl amide and vinyl acetate or salts thereof, preferably polyacrylic acid or a salt thereof (polyacrylate).

5. The process according to item 1 or 2, wherein the first aqueous liquid comprises from 1-50 wt.-%, preferably 2-20 wt.-% of a hydrophilic organic polymer based on the total mass of the first aqueous liquid.

6. The process according to any of items 1-5, wherein the first aqueous liquid further comprises at least one filler, e.g. in nanoparticulate or microparticulate form.

7. The process according to item 6, wherein the filler is an inorganic oxide, such as $SiO_2$ or $TiO_2$.

8. The process according to any of items 6 or 7, wherein the first aqueous liquid comprises from 0.2-10 wt.-%, preferably 1-5 wt.-% of filler based on the total mass of the first aqueous liquid.

9. The process according to any of items 1-8, wherein the first aqueous liquid further comprises at least one alkaline salt, such as a (hydrogen)carbonate, silicate, aluminate, or phosphate salt.

10. The process according to item 9, wherein the first aqueous liquid comprises from 0.2-10 wt.-%, preferably 1-5 wt.-% of alkaline salt based on the total mass of the first aqueous liquid.

11. The process according to any of items 1-10, wherein the second aqueous liquid comprises a hydrophilic polymer such as polyacrylate, starch, cellulose or derivatives thereof.

12. The process according to any of items 1-11, wherein the first and optionally the second aqueous liquid is applied to the base substrate in an amount of 10-40 g/m$^2$, preferably 15-25 g/m$^2$.

13. The process according to any of items 1-12, wherein after drying of the first aqueous liquid a coating having a dry weight of 0.2-25 g/m$^2$, preferably 0.2-5 g/m$^2$, is obtained on the front side of the base medium.

14. The process according to any of items 1-13, wherein after drying of the first aqueous liquid a coating layer having a porosity of greater than 100 ml/min is obtained on the front side of the base medium.

15. Use of an aqueous liquid which comprises at least one hydrophilic organic polymer, at least one filler and at least one alkaline salt for the production of a transfer medium, particularly for ink-jet printing.

16. Use of a base substrate, particularly a base paper, having a porosity of 0-1,000 ml/min, preferably from 0-200 ml/min, more preferably from 0-100 ml/min, for the production of a transfer medium, particularly for ink-jet printing.

17. A transfer medium, particularly for ink-jet printing, wherein the front side of a base substrate to be printed has a porosity of 0-1,000 ml/min, preferably 0-200 ml/mm, more preferably 0-100 ml/min, and is coated with a coating comprising at least one hydrophilic organic polymer.

18. A process for printing a transfer medium, wherein sublimable pigments are applied to the front side of a transfer medium according to item 17, for example by ink-jet printing.

19. A printed transfer medium for printing articles, in particular textiles, wherein sublimable pigments are applied to the front side of the transfer medium according to item 17.

20. A process for printing onto articles, in particular textiles, wherein the article to be printed is brought into contact with a printed transfer medium according to item 19 at increased temperature, such that sublimable pigments are transferred from the transfer medium to the article to be printed.

21. The process according to item 20, wherein the pigments are transferred to the article by means of roller printing, heat transfer roll press and/or heat transfer flat press.

22. The process according to any of items 1-14, wherein the first aqueous liquid further comprises at least one polyhydric alcohol, such as glycerol, preferably in an amount of 0.1-1.5 wt.-% based on the total mass of the first aqueous liquid.

23. The process according to any of items 1-14 and 22, wherein the first aqueous liquid further comprises at least one adhesive, such as blendex, preferably in an amount of 10-20 wt.-% based on the total mass of the first aqueous liquid.

The invention claimed is:

1. A process for manufacturing a transfer medium suitable for ink-jet printing, comprising the steps:

(a) applying a first aqueous liquid to a front side of a base substrate to be printed, wherein the base substrate has a porosity of 0-1,000 ml/min before application of the first aqueous liquid, and the first aqueous liquid comprises at least one hydrophilic organic polymer or a salt thereof and at least one water-soluble alkaline salt, wherein the hydrophilic organic polymer is selected from the group consisting of polyacrylic acid, and a copolymer comprising at least one compound selected from the group consisting of an acrylic acid, and acrylic acid ester, and wherein the water-soluble alkaline salt comprises (hydrogen)carbonate and a silicate, and subsequent drying; and (b) optionally applying a second aqueous liquid to a reverse side of the base substrate and subsequent drying, the second liquid optionally comprising a hydrophilic polymer or a salt thereof.

2. The process according to claim 1, wherein the base substrate is selected from the group consisting of paper, plastic, or metal.

3. The process according to claim 1, wherein the hydrophilic organic polymer is present in the first aqueous liquid from 1-50 wt. %, based on the total mass of the first aqueous liquid.

4. The process according to claim 3, wherein the hydrophilic organic polymer is polyacrylic acid or a salt thereof (polyacrylate), and is present in the first aqueous liquid from 2-20 wt. %, based on the total mass of the first aqueous liquid.

5. The process according to claim 1, wherein the first aqueous liquid further comprises at least one filler in nanoparticulate or microparticulate form.

6. The process according to claim 5, wherein the first aqueous liquid comprises from 0.2-10 wt. % of filler based on the total mass of the first aqueous liquid.

7. The process according to claim 6, wherein the first aqueous liquid comprises from 1-5 wt. % of filler based on the total mass of the first aqueous liquid.

8. The process according to claim 5, wherein the at least one filler is an inorganic oxide.

9. The process according to claim 8, wherein said inorganic oxide is $SiO_2$ or $TiO_2$.

10. The process according to claim 1, wherein the second aqueous liquid comprises a hydrophilic polymer.

11. The process according to claim 10, wherein the hydrophilic polymer is selected from the group consisting of polyacrylate, starch, cellulose and derivatives thereof.

12. The process according to claim 1, wherein the first and optionally the second aqueous liquid is applied to the base substrate in an amount of 10-40 $g/m^2$.

13. The process according to claim 12, wherein the first and optionally the second aqueous liquid is applied to the base substrate in an amount of 15-25 $g/m^2$.

14. The process according to claim 1, wherein after drying of the first aqueous liquid, a coating having a dry weight of 0.2-25 $g/m^2$ is obtained on the front side of the base substrate.

15. The process according to claim 14, wherein said coating has a dry weight of 0.2-5 $g/m^2$.

16. The process according to claim 1, wherein after drying of the first aqueous liquid, a coating layer having a porosity of greater than 100 ml/min is obtained on the front side of the base substrate.

17. The process according to claim 1, wherein the first aqueous liquid further comprises at least one polyhydric alcohol.

18. The process according to claim 17, wherein the at least one polyhydric alcohol is glycerol.

19. The process according to claim 17, wherein the at least one polyhydric alcohol is in an amount of 0.1-1.5 wt. % based on the total mass of the first aqueous liquid.

20. The process according to claim 1, wherein said base substrate has a porosity of 0-200 ml/min.

21. The process according to claim 20, wherein said base substrate has a porosity of 0-100 ml/min.

22. The process according to claim 1, wherein the at least one water-soluable alkaline salt is present in the first aqueous liquid from 1-5 wt.-%, based on the total mass of the first aqueous liquid.

23. The process according to claim 1, wherein the at least one water-soluable alkaline salt is present in the first aqueous liquid from 0.2-10 wt. % based on the total mass of the first aqueous liquid.

* * * * *